United States Patent [19]

Greenberg et al.

[11] 4,168,609

[45] Sep. 25, 1979

[54] FOLDED-OVER PILOT BURNER

[75] Inventors: Paul B. Greenberg, Manchester, Conn.; Earl R. Fisher, Tequesta, Fla.

[73] Assignee: United Technologies Corporation, Hartford, Conn.

[21] Appl. No.: 856,719

[22] Filed: Dec. 1, 1977

[51] Int. Cl.[2] ..... F02C 7/22; F02C 7/26

[52] U.S. Cl. ..... 60/39.36; 60/39.65; 60/39.82 P

[58] Field of Search ..... 60/39.36, 39.82 P, 39.65

[56] References Cited

U.S. PATENT DOCUMENTS

| | | | |
|---|---|---|---|
| 1,505,100 | 8/1924 | Lightfoot | 60/39.82 P |
| 3,512,359 | 5/1970 | Pierce | 60/39.36 |
| 3,631,674 | 4/1972 | Taylor | 415/117 |
| 3,691,766 | 9/1972 | Champion | 60/39.82 P |
| 3,703,081 | 11/1972 | Krebs et al. | 60/39.36 |
| 3,844,116 | 10/1974 | Matto | 60/39.36 |
| 4,045,956 | 9/1977 | Markowski et al. | 60/39.65 |
| 4,098,074 | 7/1978 | Greenberg et al. | 60/39.36 |
| 4,098,075 | 7/1978 | Greenberg et al. | 60/39.36 |

*Primary Examiner*—Robert E. Garrett
*Assistant Examiner*—Thomas I. Ross
*Attorney, Agent, or Firm*—Norman Friedland

[57] ABSTRACT

The pilot burner for a high $M_N$ inlet burner is folded to substantially reduce the overall length of the combustor. The annular burner includes a splitter design where a diffuser surrounds the burner and connects to an outer shroud which contains the inlet of the pilot burner. Flow reverses into the pilot burner where it is directed to the primary burning zone of the combustion chamber.

6 Claims, 2 Drawing Figures

ENGINE ℄
FUEL
FUEL
FUEL

FOLDED-OVER PILOT BURNER

BACKGROUND OF THE INVENTION

This invention relates to gas turbine engines and particularly to its combustion section.

Within the confines of burner efficiency, allowable pressure drop and the temperature of the gas at the inlet of the turbine, the length of the burner, whether annular can or combination thereof is kept to a minimum. Obviously, the length of the burner has a direct bearing on the size of the engine case and the engine's overall length, all of which obviously bears on the engine's installed weight. For aircraft application it is of paramount importance to hold the thrust per pound of engine at as high a value as possible.

Furthermore in a high $M_N$ airflow engine, struts in the gas path along the diffuser-burner area cannot be used inasmuch as it has an adverse affect on the airflow.

We have found that we can reduce the length of heretofore known efficient burners without deteriorating any of the other operating criteria by folding the pilot burner which in turn results in stiffer rotor or rotors, a reduction in engine length and a consequential reduction in installed engine weight.

SUMMARY OF THE INVENTION

A feature of this invention is to fold the pilot burner of a high $M_N$ inlet burner. An annular pilot burner located in the outer shroud reverses the flow discharging from the diffuser where fuel admitted thereto is combusted prior to being admitted into the primary zone of the engine's main annular burner. The shortened burner eliminates the need of support struts in the gas path in the normal diffuser-burner area that heretofore were necessary for support resulting in a reduction in total engine length and installed engine weight.

DESCRIPTION OF THE PREFERRED EMBODIMENT

Figures 1, 2:
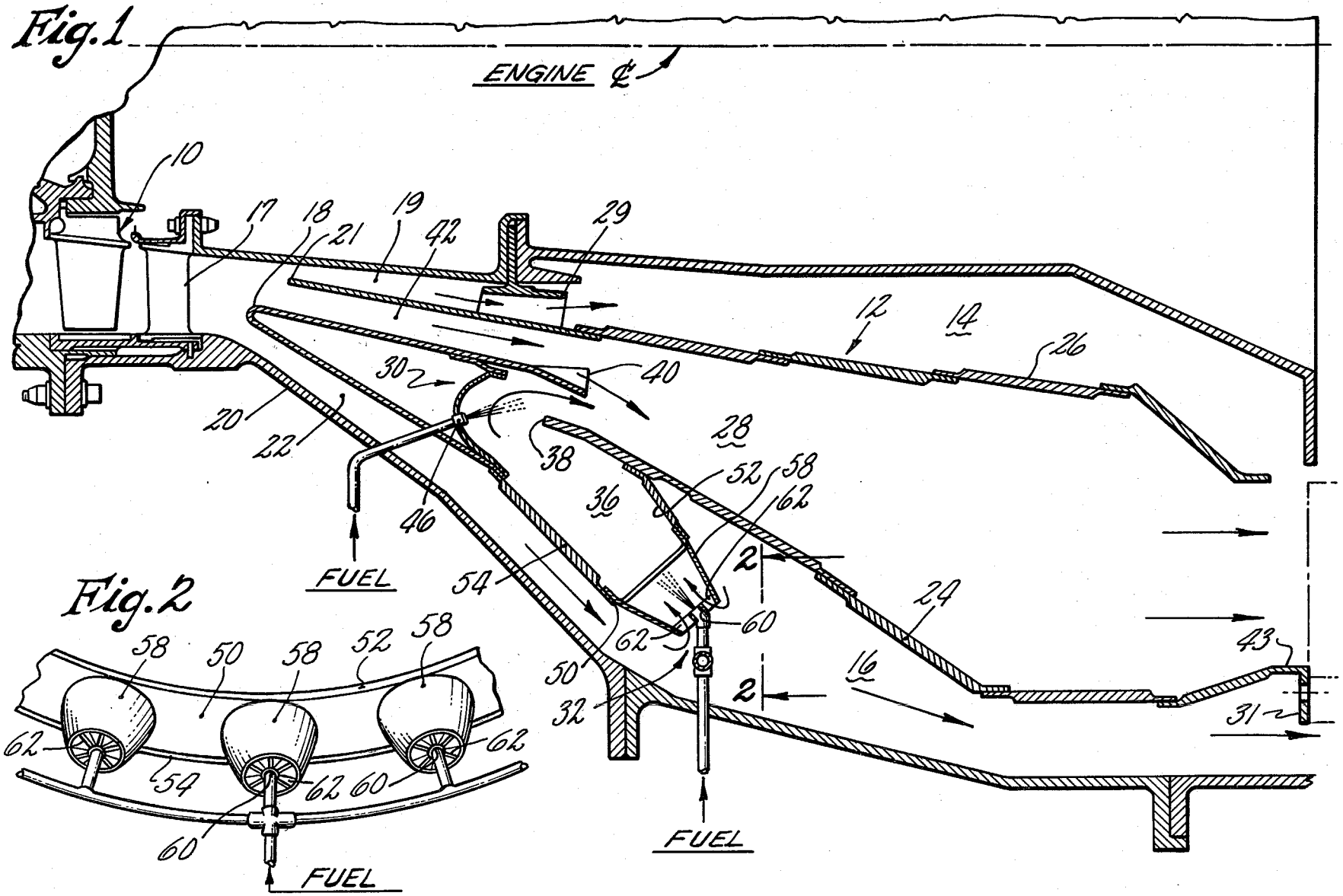
FIG. 1 is a partial view of a burner employing this invention.
FIG. 2 is a partial end view of the pilot burner.

As can be seen from FIG. 1 the air discharging from compressor 10 (one blade being shown) is proportioned so that a given amount is admitted into the burner generally indicated by reference numeral 12, inner annular passageway or shroud section 14 and outer annular passageway or shroud section 16. A ring of stator blades 17 is mounted aft of the compressor blades and as is conventional, straighten the compressor discharge air to some degree. Splitter 18 at the entrance of burner 12 defines with casing 20 diffuser passage 22 serving to lead compressor air in the outer shroud section, while diffuser passage 19 serves a similar purpose for the inner shroud section. The walls of splitters 18 and 21 define the inlet passage 42 to the main burner.

The annular burner is fabricated in the conventional manner either from louver lining elements or Finwall® liner elements that are attached end-over-end defining an outer annular wall 24 and an inner annular wall 26, spaced from each other to define the annular combustion zone 28. The inner liner wall 26 is supported by the vane 29 and the outer liner wall 24 is supported to the turbine structure (not shown) at flange 31. The combustion section includes the main burner generally indicated by reference numeral 30 and the pilot burner generally indicated by reference numeral 32. Each burner comprises suitable commercially available fuel nozzles (one being shown for each) and operate in the conventional manner. As noted in this configuration combustion air is admitted into the pilot burner 32 after discharging from diffuser 22 by first reversing its flow relative to the gas flow path in the main combustion section. This fuel/air mixture burns in the pilot burner zone 36 and discharge into the main combustion zone 28 by reversing again at the main zone entrance 38. Mixer 40 is mounted at the end of passage 42 for violently mixing the compressor discharge air in that passage and the fuel/air mixture discharging from the pilot burner. The products of combustion pass axially through combustor 28 and exit at 43 into the inlet of the turbine (not shown). Fuel to the main combustion zone is fed through nozzle 46 and may take the form of any well known fuel nozzle.

As can be seen in FIG. 2 the fuel nozzles on the pilot burner are circumferentially spaced about the periphery of the annular opening 50 defined by the inner annular walls 52 and the outer annular wall 54. Each nozzle consists of a generally cylindrical outer wall 58 and a concentric cylindrical inner wall 60 having a plurality of air turning vanes 62. Fuel is admitted into the central bore defined by inner wall 60.

By virtue of the configuration for a given burner performance, it was ascertained that the overall length of the combustor can be reduced at least 4 inches which is considerable when viewed in terms of overall engine weight.

It should be understood that the invention is not limited to the particular embodiments shown and described herein, but that various changes and modifications may be made without departing from the spirit or scope of this novel concept as defined by the following claims.

We claim:

1. An annular burner for high Mach number airflow for a turbine type power plant including an inner generally axially extending wall defining an inner wall liner section, an outer generally axially extending wall spaced from said inner wall defining an outer wall liner section and together therewith defining a main combustion zone, an inner and outer casing coaxially mounted relative to each other and defining a space for receiving said inner and outer wall liner sections, each being spaced therefrom for defining an inner shroud passageway and an outer shroud passageway, the inner and outer wall liner sections being substantially closer at its fore end relative to its rear end and having an inlet passage for receiving compressor discharge air and being in substantially axial alignment, splitter means at the inlet forming a portion of said inlet passage for proportioning some of said compressor discharge air into the inner and outer shroud passageways, a pilot burner disposed in said outer shroud passageway having an inner wall and an outer wall spaced from each other defining an annular passageway surrounding and being common to a portion of said outer wall liner section, said inner and outer wall of said pilot burner terminating intermediate the ends of said main combustion zone and defining an annular inlet for receiving compressor discharge air from said outer shroud passageway flowing in a reverse relationship to the normal flow of the main combustor working medium, at least one fuel nozzle at the inlet of said pilot burner, an exit end substantially at the forward end of said pilot burner and means for reversing the flow of pilot burner exhaust into said main combustion zone for flowing axially with said working medium.

2. An annular burner as in claim 1 including a diffuser passage intermediate the forward end of said splitter in relation to the normal flow of said working medium and the inlet of said pilot burner.

3. An annular burner as in claim 2 including a mixer mounted at the exit end of the inlet passage to said main combustion zone and the inlet receiving pilot burner exhaust to said main combustion zone.

4. An annular burner as in claim 3 including at least one fuel nozzle for directing fuel into said main combustion zone facing said inlet receiving pilot burner exhaust to said main combustion zone.

5. An annular burner as in claim 3 including a plurality of fuel nozzles circumferentially spaced about said pilot burner at the inlet thereof.

6. An annular burner as in claim 5 wherein each of said fuel nozzles includes a central opening for receiving fuel and a plurality of vanes spaced about said central opening for receiving compressor air for mixing with said fuel for burning in said pilot burner.

* * * * *